United States Patent [19]

Peck

[11] 4,090,666

[45] May 23, 1978

[54] GUN FOR TRIBO CHARGING POWDER

[75] Inventor: Richard O. Peck, Lakewood, Colo.

[73] Assignee: Coors Container Company, Golden, Colo.

[21] Appl. No.: 688,067

[22] Filed: May 19, 1976

[51] Int. Cl.[2] ..... B05B 5/02

[52] U.S. Cl. ..... 239/15; 118/629; 239/405; 361/227

[58] Field of Search ..... 239/3, 15, 403, 405, 239/416, 433, 434.5; 302/25; 317/3; 417/151, 194, 197; 118/621, 622, 629; 427/13, 25, 27; 361/225–228

[56] References Cited

U.S. PATENT DOCUMENTS

| | | | |
|---|---|---|---|
| 1,451,063 | 4/1923 | Anthony | 239/405 X |
| 1,504,443 | 8/1924 | Gibbons | 239/416 |
| 2,380,714 | 7/1945 | Winteringham | 417/197 X |
| 3,304,987 | 2/1967 | Leveque et al. | 239/405 X |
| 3,724,755 | 4/1973 | Diamond et al. | 239/15 |
| 3,889,636 | 6/1975 | Smith | 239/15 X |
| 3,903,321 | 9/1975 | Schaad | 239/15 X |

FOREIGN PATENT DOCUMENTS

| | | | |
|---|---|---|---|
| 1,101,302 | 1/1968 | United Kingdom | 302/25 |

*Primary Examiner*—Evon C. Blunk
*Assistant Examiner*—Andres Kashnikow
*Attorney, Agent, or Firm*—Kyle W. Rost

[57] ABSTRACT

A gun for tribo charging powder has a barrel body with a bore having an opening at one end. A venturi forming tube is contained in the barrel bore and a supply of powder enters the barrel through a bore of the venturi forming tube, which is in alignment with the bore of the barrel, creating an obstruction free passageway for the powder. A supply of pressurized propellant gas enters the barrel bore through an area between the outer venturi forming tube wall and the inner barrel wall and is the power source for charging the powder. Modifications for increasing the charge imparted to the powder include an insert in the venturi forming tube bore for forcing the powder to travel closer to the barrel wall upon exiting the venturi forming tube bore, and a system of holes through the venturi forming tube wall for imparting swirling motion to the powder in the venturi forming tube bore. A modification for allowing a softer spray of powder from the gun includes a nonconductive barrel end having an outwardly flared bore.

9 Claims, 8 Drawing Figures

GUN FOR TRIBO CHARGING POWDER

BACKGROUND OF THE INVENTION

1. Field of the Invention The invention relates to powder coating apparatus, more particularly to tribo-electrogas-dynamic (TEGD) powder charging apparatus. The apparatus comprises a powder gun that is especially useful for coating objects having deep recesses, for example, inside surfaces of two piece aluminum beverage cans.

2. Description of the Prior Art

Presently known powder coating apparatus generally employs an externally applied electric field to charge the powders. A first type of electrostatic charging gun uses direct current high-voltage low amperage electrical power to charge the powder particles as they leave the gun barrel. The voltage used ranges up to and in some cases exceeds 100,000 volts, creating a hazard that can cause fires from arcing and electrical shock to personnel. These types of high voltage power systems are expensive, require safety protection and are subject to failure and resultant system unreliability. Because of the position of the high voltage electrodes, an electrical field is produced between the electrodes and ground, which may be the workpiece, and if not specially protected the gun may be brought too close to the grounded workpiece or other grounded item and cause an arc. It is known that such a field, which is used to transport and guide the powder to the workpiece, greatly limits the ability of the powder to reach into any recesses in the workpiece because of the "Faraday Cage" effect.

A second type of gun in the prior art uses a set of electrodes within the body of the gun. The electrodes are arranged to have the powder pass between then with one electrode at ground and the other at high voltage of about 7,000 to 15,000 volts. This system has a smaller but finite electric field between the end of the gun barrel and the workpiece as compared to the first type of gun. Hence, the second type of gun has fewer Faraday Cage and arcing problems. This type of charging is commonly known as the electro-gas-dynanic (EGD) charging system.

Electrostatic charging by means of friction, or tribo charging, is thought to occur in several ways. One method is to cause the material to be charged to impinge on another surface by rolling, sliding, or bouncing. Another method may be to entrain the material to be charged in a charged fluid that shares the charge with the material. Another method may be to cause differential accelerations among particles of the material to be charged, causing friction between the particles.

A major problem occurs in the prior art when tribo charging of powder is attempted. Almost any powder will tribo charge if it is given sufficient rubbing contact; however, handling typical powders to get sufficient rubbing contact has undesirable consequences. If the powder is a thermoset curing resin, the material is always curing and the rate of cure is temperature dependent. Excessive rubbing can cause the powder to melt and adhere to the walls of tubes and passages, eventually clogging or fouling these passages. If the powder is propelled at a very high velocity in these passages and if the powder particles impact on objects and surfaces in these passages, the kinetic energy is converted to heat causing the powder particles to adhere and cure. This phenomenon is called "impact fusion" and can soon clog passages.

The only known tribo charging gun in the prior art is disclosed in U.S. Pat. No. 3,903,321 to Schaad and discloses a structure lacking the obstruction free configuration of the present invention. In addition, the Schaad device is limited to teflon as a construction material and charges only a few types of powders. In contrast, the present invention may be constructed of a wide variety of materials and produces a significantly higher charge with a broad range of powders.

SUMMARY OF THE INVENTION

The invention relates to guns for tribo charging powder through the use of compressed propellant gas as the power source. The gun design features an obstruction-free path for the powder, thus, charging the powder as little as possible before the powder contacts the propellant gas in the barrel of the gun and producing the least possible impact fusion and clogging both before and after the powder contacts the propellant gas. A portion of the powder path includes the uniform bore of a venturi forming tube, the outside of which cooperates with the interior of the gun barrel to form an annular venturi passage. Propellant gas passing through the narrow area becomes a high velocity stream that contacts the powder exiting the venturi forming tube bore and charges the powder as the gas and powder pass through the charging section of the gun barrel. In the charging section, the powder interacts with the propellant gas stream, the wall of the barrel bore, and other powder particles to become charged to a higher degree that has been observed in either EGD or electrostatic gun systems. Modifications for increasing charging efficiency include an insert in the bore of the venturi forming tube and a system of holes in the venturi fornming tube wall that cause the powder in the venturi bore to swirl in a spiral motion.

An object of the invention is to provide a powder charging gun that needs no external source of electrical power, thereby being safer than conventional systems that are externally electrically charged.

Another object is to provide a powder charging system with no electrodes to foul.

An important object is to provide a powder charging gun that operates without an externally applied electric field and is able to coat deep recesses with powder.

Another important object is to provide a gun with a simple and inexpensive design that will allow simple operating requirements and reliable function.

A further object is to provide a gun that will produce a substantially higher unit of charge than is found with presently known equipment.

Another object is to provide a straight through design of the powder passage in a self charging gun, thereby reducing the tendency to foul and reducing the need for cleaning.

An additional object is to provide a powder charging gun with an inherent ability to draw powder from the powder supply equipment.

DESCRIPTION OF THE PREFERRED EMBODIMENT

Figure 1:
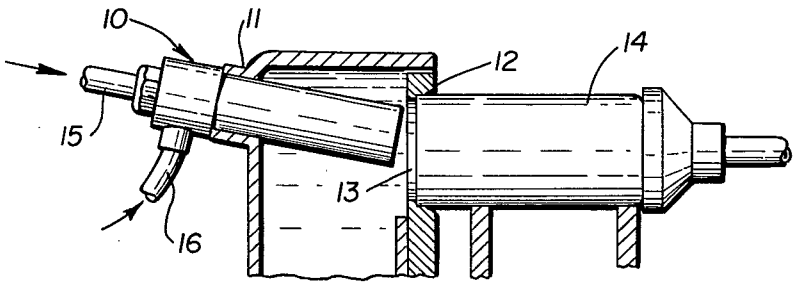
FIG. 1 is an elevational view in partial section of the gun and associated equipment with which it may be used.

As shown in FIG. 1, the gun 10 may be used in powder coating equipment that may include a gun support 11 and mask plate 12 having aperture 13. A workpiece such as aluminum can body 14 may be inserted into aperture 13 for internal coating with powder. The gun 10 is connected by conduit 15 to a supply of suitable powder which may be delivered entrained in a carrier gas, and is connected by conduit 16 to a supply of compressed propellant gas. The gun may operate continuously while mask plate 12 moves, bringing a series of workpieces before the gun to be powder coated. The gun is suited not only to coat the internal surfaces of deep recesses, but also may coat external surfaces or may be applied in other industrial finishing applications.

Figure 2:
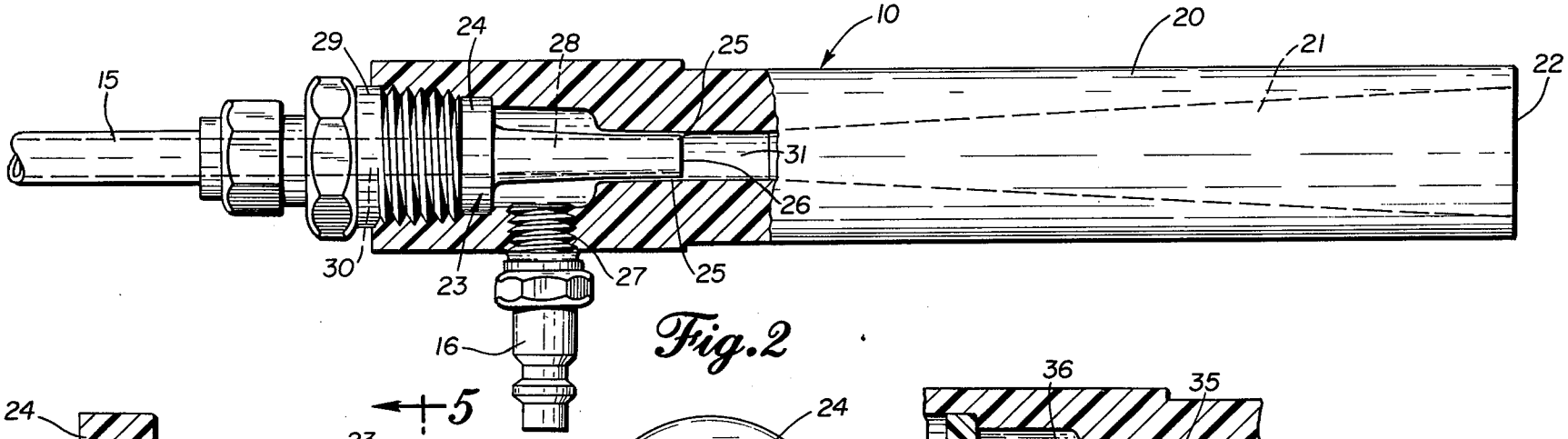
FIG. 2 is a longitudinal sectional view of the gun showing its main components.
Figure 4:
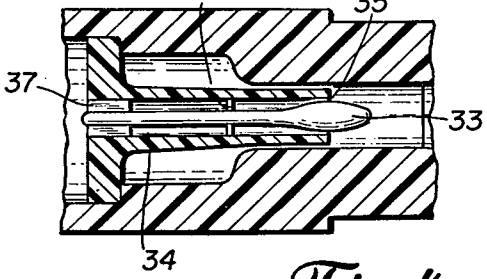
FIG. 4 is an enlarged longitudinal sectional view showing the venturi forming tube and an insert that may be used in the venturi forming tube in a modification of the gun construction.
Figure 5:
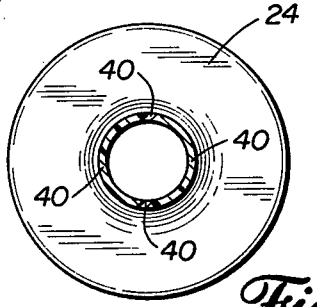
FIG. 5 is a transverse sectional view along line 5—5 of FIG. 3, showing details of modification of the venturi forming tube.
Figure 3:
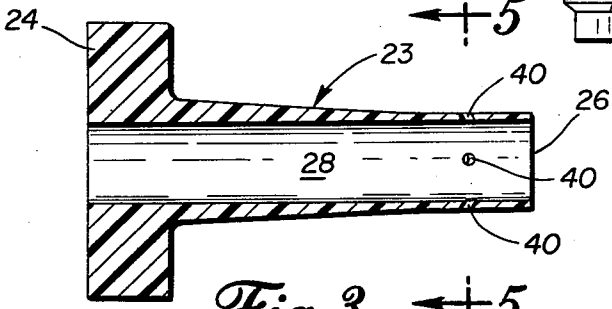
FIG. 3 is an enlarged longitudinal sectional view of the venturi forming tube, also showing a modification of the venturi forming tube.
Figure 8:
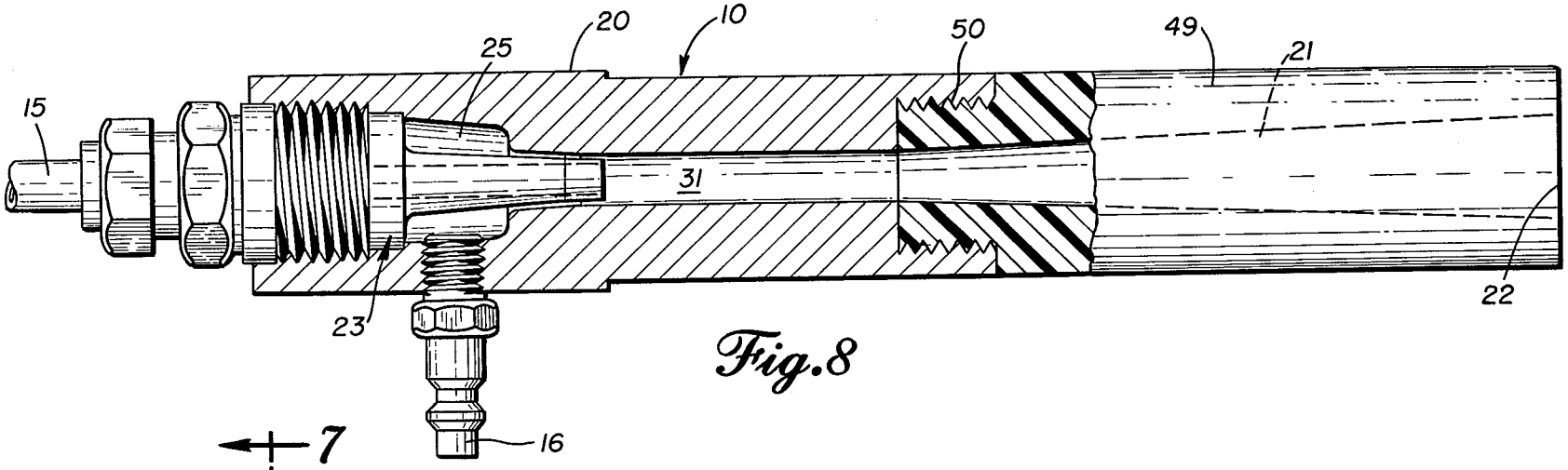
FIG. 8 is a longitudinal sectional view of the gun showing a modification of the barrel.
Figure 7:
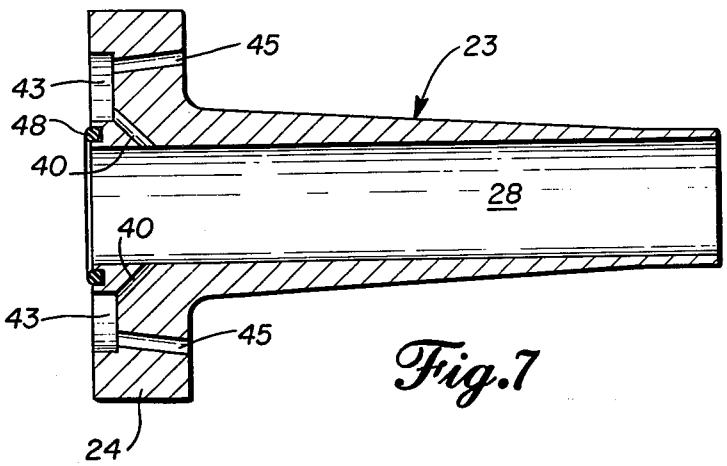
FIG. 7 is an enlarged longitudinal sectional view of the venturi forming tube as seen in the place of line 7—7 of FIG. 6.

In the construction shown in FIG. 2, the gun 10 has barrel body 20 having bore 21 and opening 22 at one end thereof. Venturi forming tube 23, herein referred to as the venturi tube or the venturi, shown in greater detail in FIG. 3, is secured in the bore 21 of barrel 20 at base end 24. When the venturi 23 is in place in barrel 20, a narrow annular area 25 is created between the interior wall of barrel 20 defining a portion of bore 21 and the exterior wall of venturi 23 adjacent to narrow end 26. The venturi forming tube 23 is a sleeve within the bore of barrel 20 that creates a venturi passage at narrow annular area 25 between the exterior of the sleeve and the interior of the barrel bore at end 26. As best shown in FIGS. 3 and 7, the tube 23 has a tapering outer diameter between base 24 and end 26, with the portion of the tube immediately adjacent to end 26 having a uniform outer diameter. As best shown in FIGS. 2 and 8, the barrel bore 21 is non-decreasing in internal diameter forwardly of end 26 of venturi forming tube 23 in place in the bore 21. In one embodiment of the gun 10, the barrel bore at end 26 of the venturi tube may be approximately ⅜ inch in diameter, and annular area 25 between the exterior of the venturi and the barrel wall may have a radial dimension from 0.005 to 0.010 inch. The preferred radial dimension of area 25 at end 26 is from 3% to 7% of the radius of bore 21 adjacent to venturi end 26. Means for delivering compressed propellant gas, such as port 27 through the wall of barrel body 20 and conduit 16 connected to port 27, deliver a supply of propellant gas to the annular area 25. The bore 28 of venturi 23 receives a supply of powder from powder delivery means such as conduit 15 connected to plug 29 at port 30. In the embodiment shown, plug 29 also serves as securing means holding venturi 23 in its proper position in barrel 20. The bore of conduit 15 is in axial alignment with and of the same diameter as port 30 and venturi bore 28, thereby providing a relatively obstruction-free passageway for the powder and reducing impact fusion and clogging. Grounding means such as an electrically conductive wire (not shown) grounds the gun to complete the tribo electric circuit and limits the potential of the gun on long term usage. The gun performs when not grounded, but the performance declines as the potential of the barrel increases. A grounding wire also provides for the electrical safety of the gun. A D.C. ammeter (not shown) may be inserted as a series element in the ground circuit to monitor gun performance.

In operation, impact fusion is minimized not only by the straight tube design of the powder delivery means and venturi bore, but also by using the lowest reasonable powder velocity from the powder supply to the charging section 31 of the gun. The powder exits the venturi bore 28 and enters the charging section 31 partially in response to the compressed propellant gas which, due to venturi action, draws the powder to the gun. The annular area 25 between the outside diameter of the venturi and the inside diameter of the barrel is designed to provide the proper compressed gas flow for efficient charging. If the area is too small, even though the propellant gas velocity may be high, there may not be sufficient gas volume, here serving as the measure of energy, to adequately charge the powder. If the area 25 is too large, gas usage will be high and the velocity of the gas and powder stream exiting the barrel may be too high to be compatible with the coating technique for some workpieces.

The powder and carrier gas mixture moves relatively slowly until it comes under the influence of the very high velocity gas from the annular area 25 at end 26 of the venturi tube, causing the powder to accelerate as it enters charging section 31. Tests indicate that no significant charging occurs in the conduit 15 from the powder supply to the venturi 23. The carrier gas may be the same as or disimilar to the propellant gas exiting area 25.

Powder charging in this gun is believed to result from various combinations of the following phenomena. The powder probably begins to speed up before it gets to the end 26 of the venturi tube. This may cause some rubbing and resultant charging from contact with the venturi tube. As the powder is rapidly accelerated when entering the high velocity annular propellant gas stream, some rubbing on the inside surface of the barrel occurs, charging the powder. Also, there is a gradient of velocity in the radial direction within the powder stream that causes differential velocities among powder particles, resulting in collisions among particles also charging the powder. Once the powder is charged, a space charge situation occurs in which all the particles of like charge repel each other, causing two results: first, the powder stream tries to expand within the gun barrel and therefore impinges on the surface of the bore 21 thus enhancing the charge level, and second, charge sharing between highly charged and less charged particles may occur, allowing all of the particles to become charged even though not all of the particles impinge on the barrel surface.

The value of this tribo charging gun is shown in part by its surprising charging efficiency. The experimental method of determining charging efficiency was to measure the charge given up by the powder particles to a target, the measurement being that of charge-to-mass ratio given in microcoulombs per gram of powder collected by the target. In addition, by recording the time during the test, the rate of average powder delivery and the average power generation can be determined. The method of testing charging efficiency measures the average amount of charge given up to the target by those particles that adhere to the target. The amount of charge given up may vary because of particle shape, size and formulation. The method measures only the charge on those particles that do adhere to the target, but account of particles that do not adhere to the target is taken by measuring the amount of powder that goes through the fun versus the amount that adheres to the target.

This experimental method is not useful with common electrostatic charging guns that have an external electric field, but it is well known that the amount of charge on the powder is small and that such system rely on the high electric field strength to achieve adequate coating performance. The EGD system imparts a relatively large amount of charge on the powder and has a charging efficiency with most powders from 3.5 to 5.5 microcoulombs per gram of powder.

With the present invention and with powders that charge readily, charging efficiencies of 20 to 30 microcoulombs per gram are common. Such results are a function of both gun configuration, already described, and powder characteristics. Representative results with a powder delivery rate of 0.500 gm/sec. and propellant gas flow of 4.7 cfm are as follows: with Celanese MDS 117A powder, a charging efficiency of 10.5 microcoulombs/sec. was achieved; with Dupont Surlyn powder efficiency was 3.8 microcoulombs/gm. Because of the configuration of the present gun and the velocity used, clogging is not a problem.

A modification of the basic gun design includes an insert 33 in the venturi. The insert may be in axial alignment with the bore 28 of the venturi and is spaced from the bore 28 by an annular area 34 and creates annular opening 35 at end 26. Supporting means such as a spider support 36 and fins 37 may hold the insert in place. Powder exiting annular area 34 is caused to travel through opening 35 close to the barrel surface as it exits the venturi tube 23. While this modification may cause clogging when used with powders highly susceptible to impact fusion, it may be valuable for charging powders that are not subject to significant impact fusion. The insert increases the charge efficiency.

Another modification of the basic gun design includes means for imparting a swirling motion to powder within the gun. While the compressed propellant gas is the power source for tribo charging powder, the high velocity stream of propellant gas exiting area 25 also creates a barrier preventing some powder from contacting the bore 21 of barrel 20. The previously described insert causes more powder to contact bore 21 despite the presence of the propellant gas stream. Another means for directing powder against bore 21 is a hole 40 in the wall of venturi 23 causing a spiral swirling of powder within venturi bore 28. Centrifugal force then directs the powder radially outwardly from the axis of bore 21 and against the bore wall, increasing the charge on the powder.

The spiral motion within venturi 23 is caused by propellant gas from annular area 25 passing through hole 40 and entering the bore 28 at an angle directing the gas in a spiral around bore 28 and toward end 26. Hole 40 has a forward angular component, for example 30° to 60° with a preferred angle of 60°, slanting inwardly and toward end 26 in a plane including the axis of bore 28, and a lateral angular component, for example 30° to 60° with a preferred angle of 45°, measured from a line tangent to the outer wall of the venturi and in a plane perpendicular to the axis of bore 28. A plurality of holes 40, for example four or eight, spaced around the circumference of bore 28 is preferred. The holes 40 may be extremely small with positive results seen at diameters as small as 0.010 in. The presently preferred range is from 0.014 to 0.028 in. and the single preferred size is 0.020 in.

Experimental results with the basic gun design using the charge measurement system previously described reveal that at a given propellant gas pressure, a low powder delivery rate such as 0.15 gm./sec. will result in a charging efficiency of, for example, 10 microcoulombs/gm. This value may be used as the maximum charge to be derived from the gas pressure and powder used. As powder delivery rate is increased, the charging efficiency decreases, for example, to 3.9 microcoulombs/gm. at 0.80 gm./sec powder delivery rate.

Experiments using four holes of the sizes indicated achieved significant increases in charging efficiency at increased powder delivery rates.

TABLE 1

SIZE OF HOLES IN VENTURI VS. CHARGING EFFICIENCY

EXPRESSED IN MICROCOULOMBS PER GRAM OF POWDER DELIVERED AT POWDER DELIVERY RATE OF 0.80 GM./SEC.

| Hole size (in.) | Charging Efficiency |
|---|---|
| 0.000 | 3.9 |
| 0.010 | 4.5 |
| 0.014 | 7.7 |
| 0.020 | 7.7 |
| 0.028 | 7.7 |

As shown in Table 1, hole sizes from 0.014 in. and up achieved approximately equal results. As powder delivery rates decreased, all of the experimental results converged in the area of the 10 microcoulombs/gm. figure previously suggested as representing the maximum charge efficiency for the test parameters. While further increasing the number and size of holes may produce satisfactory results, economics dictate that the minimum practical amount of propellant gas be used in the powder coating gun. Accordingly, the size and number of holes using the least amount of propellant gas is the preferred combination.

Figure 6:
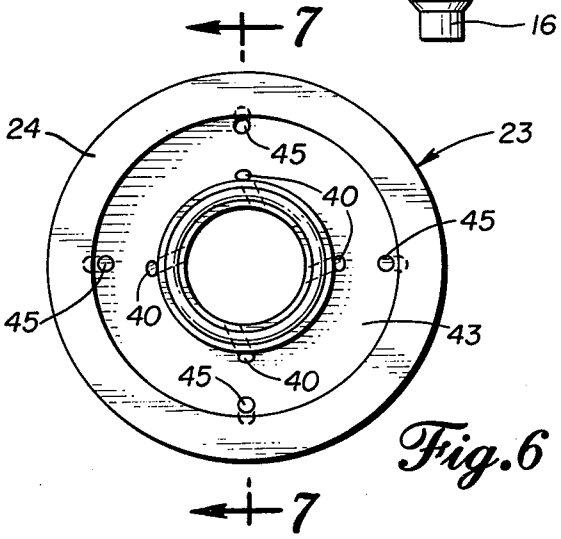
FIG. 6 is an enlarged end view of the venturi forming tube as seen from the base end and showing a modification, thereof.

Another modified form of venturi tube 23 is shown in FIGS. 6 and 7. The rear end of base 24 is provided with an annular groove 43 and the spiral holes 40 are drilled from groove 43 into bore 28 as previously described. In addition, holes 45 connect annular area 25 to groove 43, providing a passage of pressurized propellant gas to reach groove 43 and enter holes 40 in base end 24. Placing the holes 40 near base end 24 allows a longer time for swirling to develop through tube 23 and results in greater contact between the powder and the walls of bore 21, resulting in more highly charged powder. A seal ring 48 between groove 43 and bore 28 prevents propellant gas from leaking behind venturi tube end 24.

A variety of materials, both conductors and nonconductors, are suitable for the construction of the gun barrel 20 and venturi tube 23. Among the nonconductors, delrin, nylon, teflon, and ceramic work well, and among the conductors aluminum and stainless steel are suitable. Aluminum is the preferred material for both the barrel 20 and the venturi tube 23 because of its hardness and conductivity. The primary charging mechanism in the gun is believed to be friction between the powder particles and the barrel 20. Accordingly, the highest degree of charging is achieved when the powder particles impact against the hardest barrel material. Aluminum is relatively hard but remains easy to machine and is of low cost, making it a preferred material over harder substances. In addition, aluminum is a good conductor and may be grounded to remove excess charge accumulated during the powder charging process.

For some applications, such as coating the interior of a can body 14 as shown in FIG. 1, the spray from the gun 10 is desired to be relatively soft and wide, providing coverage for the walls of the can as well as the bottom end. For this purpose, bore 21 may be flared as it approaches open end 22, the flare both decreasing the velocity of powder approaching end 22 and widening the spray of the powder. At some point, the velocity of the powder will decrease to where the amount of charge being generated by impact between the powder and barrel walls is less than the charge being lost from the powder to the barrel walls, and the charging efficiency of the gun will decrease. In order to reduce the loss of charge and retain the advantages of a metallic barrel and flared bore, the barrel end may be modified as shown in FIG. 8. A nonconductive flared barrel end 49 constructed, for example, of delrin, replaces a portion of the one piece barrel shown in FIG. 2. The modified barrel end may be connected to the charging section 31 of the bore by a simple threaded connection 50. This modified barrel end reduces the dissipation of charge as the powder passes through the flare at reduced velocity.

I claim:

1. A gun for tribo charging powder, comprising:

(a) a barrel body having a bore with an opening at one end thereof, (b) a venturi forming tube mounted in the barrel having a bore in alignment with the bore of said barrel and having an area forming a venturi passage between a portion of the interior wall of said barrel and a portion of the exterior wall of the venturi forming tube, said area opening to the barrel bore substantially in the direction of said barrel opening, (c) means for delivering propellant gas to the area between said barrel bore and said venturi forming tube, (d) means for delivering powder to the bore of said venturi forming tube, and (e) wherein said venturi bore has a hole in its side allowing propellant gas from said area to spirally enter the bore of the venturi forming tube, said hole angling toward the axis of said venturi bore with forward and lateral angular components; the venturi forming tube further comprising a base end having a groove in its rear side and a ported connection between the groove and the area between the exterior of the venturi forming tube and the interior of the barrel allowing propellant gas into the groove, and wherein said hole passes from the groove to the venturi bore.

2. The gun of claim 1, wherein said area between the venturi forming tube and the interior wall of the barrel is annular and has a radial dimension of from 3% to 7% of the radius of the barrel bore at the point where the annular area opens to the barrel bore.

3. The gun of claim 1, wherein said barrel body is constructed of conductive material.

4. The gun of claim 1, wherein said barrel body is constructed of aluminum.

5. The gun of claim 1, wherein said barrel body is constructed of conductive material for easy grounding to remove excess charge accumulated during the powder charging process and has a terminal nonconductive portion containing a flared bore attached adjacent to said bore opening for preserving the charge on said powder while slowing and broadening the spray of charged powder.

6. A gun for tribo charging powder, comprising:

(a) a barrel body having a bore with an opening at one end thereof, (b) a venturi forming tube mounted in the barrel and having a bore in alignment with the bore of said barrel, the tube and barrel having an area therebetween forming a venturi passage opening to the barrel bore substantially in the direction of said barrel opening, the barrel bore being non-decreasing in internal diameter from the opening of the venturi passage to the opening of the barrel bore, wherein the bore through said venturi forming tube is of uniform diameter and the wall of the venturi forming tube between the barrel bore and the venturi forming tube bore has a hole therein allowing propellant gas from the exterior of the venturi forming tube to enter the venturi forming tube bore in a single spiral direction around the axis of the venturi forming tube bore to urge powder against the wall of the venturi forming tube bore and the wall of the barrel bore, said hole angling toward the axis of the venturi forming tube bore with forward and lateral angular components, (c) means delivering propellant gas to the area between the barrel bore and the venturi forming tube, the gas exiting the area through said venturi passage and forming a high velocity gas stream along the wall of the barrel bore, and (d) means delivering powder to the bore of the venturi forming tube.

7. The gun of claim 6, wherein said forward angular component is from 30° to 60° measured from the axis of the venturi bore in a plane including the venturi bore, and said lateral angular component is from 30° to 60° measured from a line tangent to the outer wall of the venturi forming tube and in a plane perpendicular to the axis of the venturi bore.

8. The gun of claim 6, wherein said hole has a diameter in the range from 0.010 in. to 0.028 in.

9. The gun of claim 6, wherein said hole has a diameter in the range from 0.014 to 0.028 in.

* * * * *